US008967154B2

(12) United States Patent
Mitchell

(10) Patent No.: US 8,967,154 B2
(45) Date of Patent: Mar. 3, 2015

(54) BRIQUETTE IGNITION DEVICE

(75) Inventor: Tonia Mitchell, Yonkers, NY (US)

(73) Assignee: Zooka Lighters, Yonkers, NY (US)

( * ) Notice: Subject to any disclaimer, the term of this patent is extended or adjusted under 35 U.S.C. 154(b) by 1016 days.

(21) Appl. No.: 12/973,040

(22) Filed: Dec. 20, 2010

(65) Prior Publication Data

US 2012/0152225 A1 Jun. 21, 2012

(51) Int. Cl.

| | |
|---|---|
| ***A24F 1/30*** | (2006.01) |
| ***A24F 5/04*** | (2006.01) |
| ***A24F 5/14*** | (2006.01) |
| ***F23Q 13/04*** | (2006.01) |
| ***F23Q 2/00*** | (2006.01) |

(52) U.S. Cl.
CPC . *F23Q 13/04* (2013.01); *F23Q 2/00* (2013.01)
USPC ..... 131/330; 131/183; 131/185; 131/186; 131/193; 131/196

(58) Field of Classification Search
USPC ..... 131/330, 173, 176, 183, 174.2, 185, 131/186, 193, 196
See application file for complete search history.

(56) References Cited

U.S. PATENT DOCUMENTS

| | | | | |
|---|---|---|---|---|
| 3,791,390 | A * | 2/1974 | Hendricks | 131/196 |
| 3,986,516 | A * | 10/1976 | Brooks | 131/185 |
| 2008/0173300 | A1* | 7/2008 | Justman | 128/200.11 |
| 2011/0226266 | A1* | 9/2011 | Tao | 131/185 |
| 2011/0240047 | A1* | 10/2011 | Adamic | 131/328 |
| 2011/0308537 | A1* | 12/2011 | Khoury et al. | 131/174 |

FOREIGN PATENT DOCUMENTS

| | | | |
|---|---|---|---|
| GB | 190822939 A | * | 8/1909 |
| JP | 10300087 A | * | 11/1998 |

OTHER PUBLICATIONS

English Abstract of JP 10-300087 (May 12, 2014).*

* cited by examiner

*Primary Examiner* — Sing P Chan
(74) *Attorney, Agent, or Firm* — Leason Ellis LLP

(57) ABSTRACT

An igniter for an incendiary briquette of a type suitable for smoking a smoking substance disposed in a bowl of a hookah is disclosed. The igniter includes a housing defining an interior and having a sidewall, a bottom wall, and a top opening providing access to the interior. An ignition source that produces a flame is disposed in the interior of the housing. The igniter includes a removable tray for supporting the incendiary briquette. The tray has at least one heat transfer hole therein and is sized to be removably supported by the housing at a location above the flame of the ignition source, wherein heat flows upwardly to cause a burning of the incendiary briquette. The tray is sized to seat above the bowl of the hookah so that the burning briquette is supported to cause a burning of the smoking substance.

16 Claims, 4 Drawing Sheets

BRIQUETTE IGNITION DEVICE

FIELD OF THE INVENTION

The present invention concerns accessories for smoking implements. More particularly, the invention concerns a device for the ignition of a smoking briquette.

BACKGROUND OF THE INVENTION

Smoking tobacco and other smoking matter such as various herbs, spices, and other plant matter has been a tradition for centuries. Many devices have been developed to assist in the smoking of such smoking matter, including various types of pipes and hookahs. The main parts to a hookah include a bowl for the tobacco, a hollow tube providing an air passage between the bowl and a water jar, and a hose that provides an air passage from the water jar to the person smoking the hookah. Although smoking matter other than tobacco can be smoked, smoking tobacco is most common and will be referred to herein as the smoking matter, but it is to be understood that any suitable smoking matter can be used. Smoke is drawn from the burning tobacco in the bowl, down the hollow tube, into the water jar, and from the water jar through the hose to the smoker.

Burning briquettes are placed above the tobacco in the bowl to burn the tobacco. The briquettes can be made from wood, sawdust, or coconut, for example. Once the briquettes are ignited they continue to burn, smolder, and maintain an ember for a period of time. Whether in a home or at a public hookah bar, the briquettes are typically ignited over a stove at location remote from the hookah. Once the briquettes are ignited, they are removed from the stove with tongs and placed in a serving dish and transported to the hookah. Tongs are then used to remove the briquettes from the serving dish and place them over the tobacco in the hookah. This process is both inconvenient and possesses safety risks. The process of lighting the briquette requires supervision because leaving a briquette burning on a stove unattended creates a potential fire hazard. This means that someone has to be dedicated to the chore of lighting the briquette, using time and separating that person from others around the hookah. Further, removing burning, hot briquette from the stove and transporting it from the stove to the hookah creates a further hazard because the briquette could be dropped.

The present invention addresses these problems by providing a small, self contained briquette igniter that can be located close to the hookah.

SUMMARY OF THE INVENTION

According to one aspect of the invention, an igniter for an incendiary briquette of a type suitable for smoking a smoking substance disposed in a bowl of a hookah includes a housing and defining an interior having a sidewall, a bottom wall, and a top opening providing access to the interior. An ignition source is disposed in the interior of the housing and supported by the bottom wall. The ignition source produces a flame. The device includes a removable tray for supporting the incendiary briquette. The tray has at least one heat transfer hole therein and is sized to be removably supported by the housing at a location above the flame of the ignition source, wherein heat from the flame flows upwardly through the heat transfer hole to cause a burning of the incendiary briquette. The tray is sized to seat above the bowl of the hookah so that heat from the burning briquette flows downwardly through the heat transfer hole to cause a burning of the smoking substance.

In a more particular, optional arrangement, the igniter further includes a lid movably supported relative to the sidewall of the housing. The lid is movable between an open state wherein the interior of the housing is accessible, and a closed state wherein the lid is disposed over the top opening of the housing.

In a further arrangement, the igniter the lid, the tray, and the sidewalls of the device provide a substantially air tight seal in the closed state, and wherein the sidewall of the housing includes an access hole sized to provide finger access to the ignition source and to restrict air flow into the interior of the housing so that the air flow is sufficient to maintain the flame of the ignition source prior to the burning of the incendiary briquette, and the air flow is sufficiently restricted such that upon the burning of the incendiary briquette the interior of the housing fills with smoke causing a self-extinguishing of the flame.

According to further optional arrangements, the sidewall of the housing includes an access hole sized and positioned to provide access by a finger to the ignition source.

In more particular, optional arrangements the tray includes a plurality of heat transfer holes.

In further, optional arrangements, a mesh is supported by tray so that the mesh extends across the plurality of heat transfer holes.

In yet a further, possible arrangement, the tray includes a single heat transfer hole.

According to further optional arrangements, a mesh is supported by tray so that the mesh extends across the single heat transfer hole.

In a further particular, possible arrangement, the tray includes a handle.

In further, optional arrangements, the handle is non-heat conducting.

In a more particular, possible aspect, the ignition source is a fuel and wick lighter.

In yet a further, possible arrangement, a sleeve is supported by the bottom wall in the interior of the housing, wherein the sleeve sized to receive the ignition source.

In further, optional arrangements, the ignition source is a candle.

In more particular, optional arrangements a grip member is supported by the sidewall of the housing.

In further, optional arrangements, the grip member is non-heat conducting.

According to further optional arrangements, a self-extinguishing igniter for an incendiary briquette of a type suitable for smoking a smoking substance disposed in a bowl of a hookah includes a chimney having walls defining an internal chamber. An ignition source is disposed within the chimney and supported thereby, the ignition source producing a flame. The igniter includes a removable tray for supporting the incendiary briquette. The tray has at least one heat transfer hole therein and is sized to be removably supported by the chimney at a location above the flame of the ignition source, so that heat from the flame flows upwardly through the heat transfer hole to cause a smoking of the incendiary briquette. A cover is movably disposed above the tray, wherein the cover, tray, and walls of the chimney provides a substantially air tight seal. The walls of the chimney include an access hole sized to provide finger access to the ignition source and to restrict air flow into the internal chamber of the chimney so that the air flow is sufficient to maintain the flame of the ignition source prior to a smoking of the incendiary briquette, and the air flow is sufficiently restricted such that upon a smoking of the incendiary briquette the internal chamber fills with smoke causing a self-extinguishing of the flame.

Various features, aspects and advantages of the invention can be appreciated from the following Description of Certain Embodiments of the Invention and the accompanying Drawing Figures.

DESCRIPTION OF THE DRAWING FIGURES

DETAILED DESCRIPTION OF CERTAIN EMBODIMENTS OF THE INVENTION

By way of overview and introduction, the present invention is described in detail in connection with a portable, self-contained, compact igniter for a briquette.

Figure 1B:
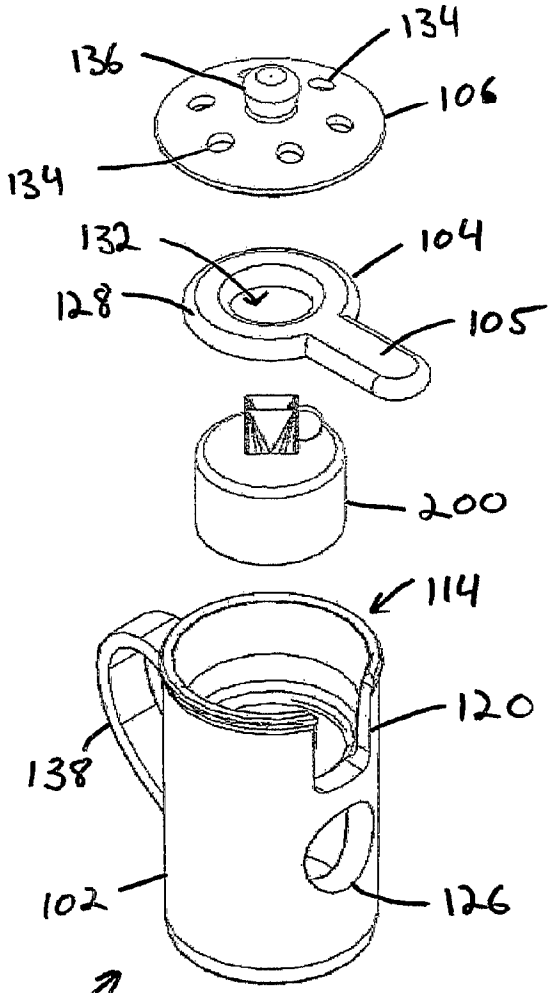
FIG. 1B is an exploded perspective view of the ignition device of FIG. 1A.
Figure 1A:
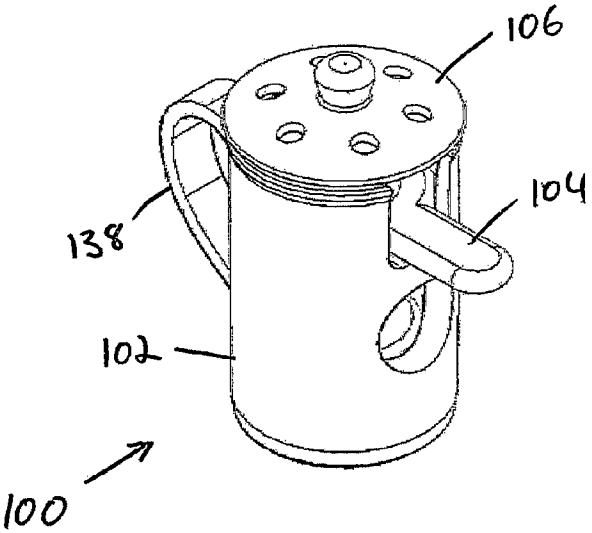
FIG. 1A is an perspective view of an ignition device according to an embodiment of the invention.

In one implementation, referring to FIGS. 1A and 1B, a briquette igniter 100 includes a housing 102, a tray 104, and a lid 106. An ignition device 200 (e.g. a lighter) is housed within the housing 102.

The housing 102 that defines an interior space and has a sidewall 108 and a bottom wall 110 112. The housing 102 has a top opening 114 that provides access to the interior space 112 of the housing. The housing 102 is illustrated as being cylindrical in shape, but other shapes are contemplated. The housing 102 constitutes a chimney that allows for the burning of an incendiary briquette. The housing can be made from metal, ceramic, or other material. Ceramic or stoneware is preferred due to its ability to withstand high heat and non-flammable characteristics, its relatively low heat transfer rate (insulating), and relative low cost and easy to manufacture.

Figure 2B:
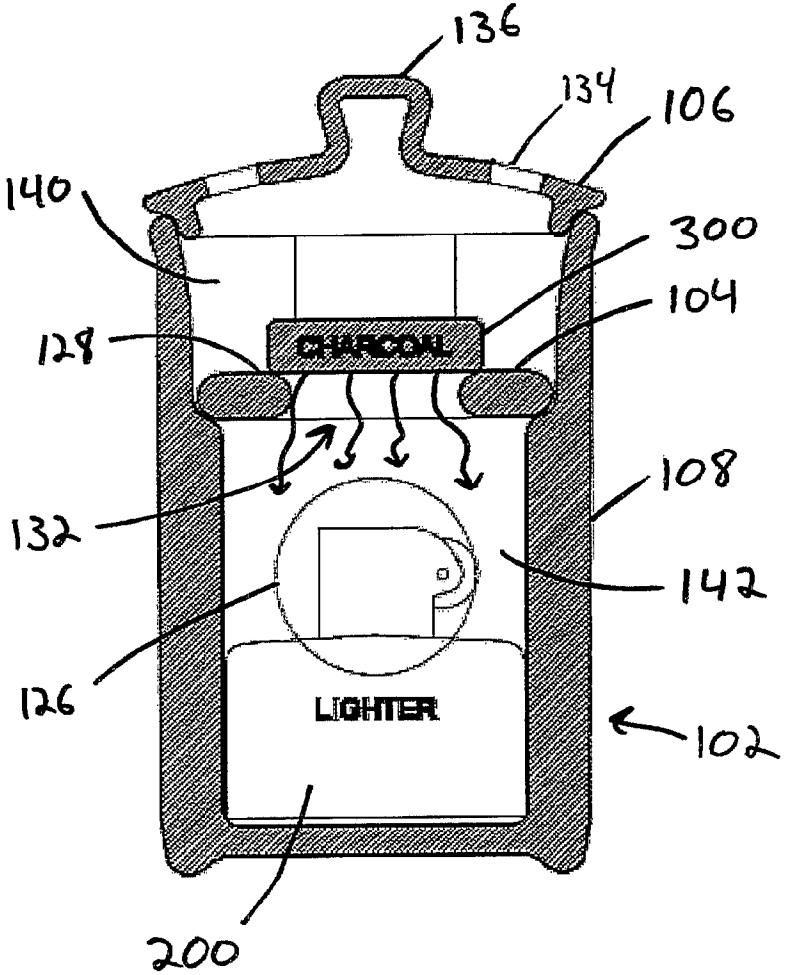
FIG. 2B is an cross-section view of the ignition device of FIG. 1A.

A shoulder 116 is formed on the interior side 118 of the sidewall 108 of the housing. The shoulder 116 removably seats the tray 104, as can be seen in FIG. 2B. Shoulder 116 is a ridge or lip in the sidewall 108 that holds the tray 104 above the lighter 200. A cut-out or notch 120 is provided in the sidewall 108 of the housing to accommodate the handle 105 of the tray 104.

The upper portion 122 of the sidewall 108 removably seats the lid 106. The upper portion 122 can be formed with a lip that is complementarily shaped to seat the lid 106. The lid 106 provides a closes the top opening 114 of the housing 102 when the lid 106 is seated on the upper portion 122. Removing the lid 106 provides access to the interior 112 of the housing 102 through the top opening 114.

Figure 2A:
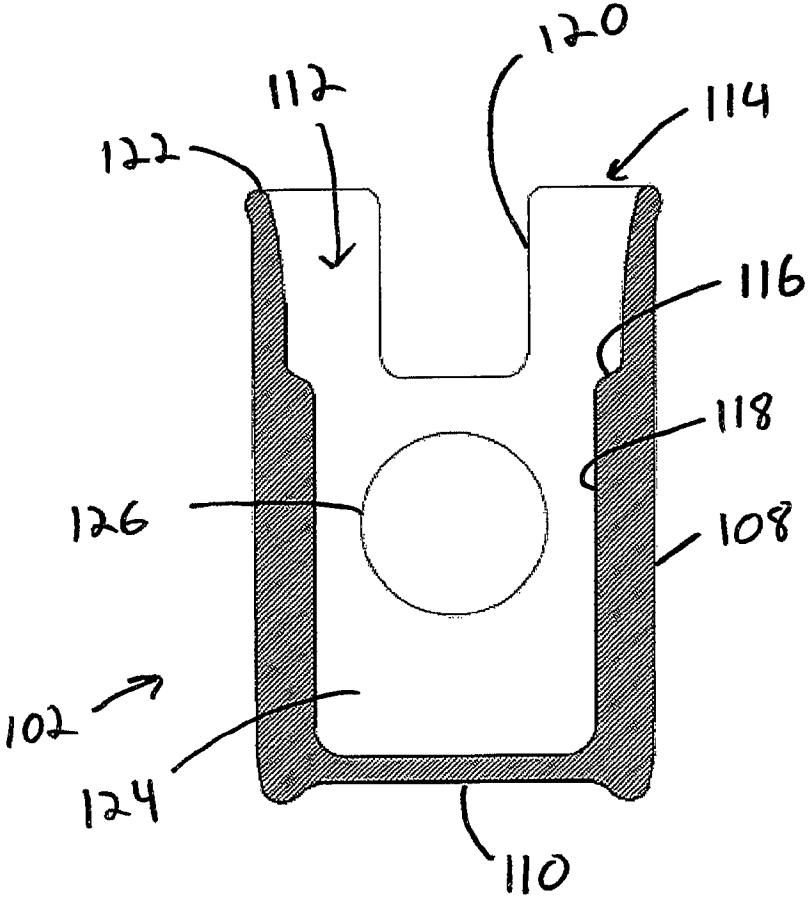
FIG. 2A is cross-section view of a housing of the ignition device of FIG. 1A.

The interior bottom portion 124 of the housing 102 is sized and shaped to receive the lighter 200. As can be seen in FIGS. 2A and 2B, the round shaped lighter 200 is received in the interior bottom portion 124 of the housing 124. The lighter 200 is restricted from side-to-side movement. However, the lighter 200 can be removed and reinserted vertically into the interior bottom portion 124 so that the lighter can be replaced or refilled when it runs low on fuel. Thus, the interior bottom portion itself 124, or a fingers supported in the interior 112 provides a sleeve into which the lighter can be inserted and held in place. The ignition source can also be a candle.

Figure 3:
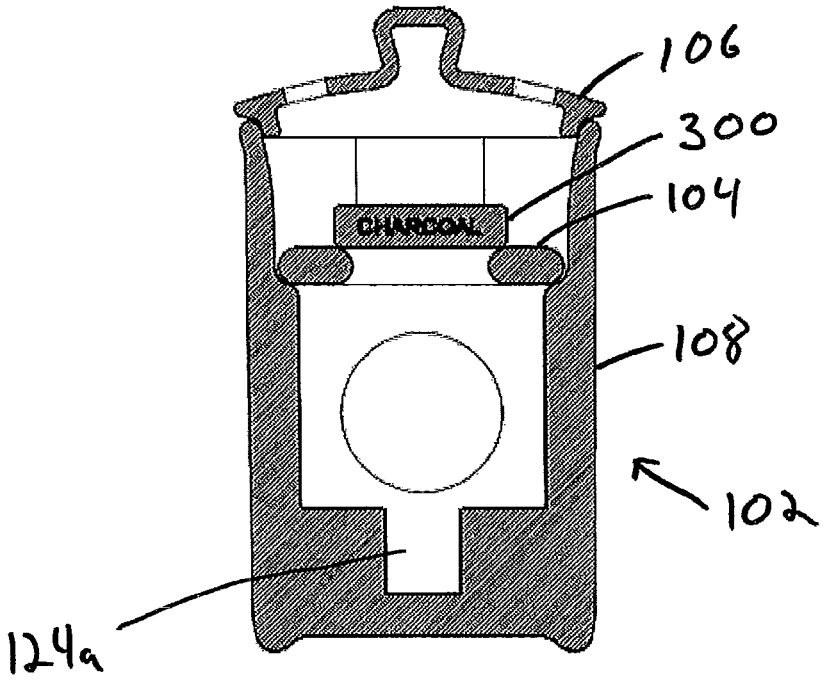
FIG. 3 is cross-section view of a housing according to another embodiment of the invention.

As can be seen in FIG. 3, alternatively the interior bottom portion 124*a* of the housing 102 has a rectangular shape and is sized and shaped to receive a rectangular shaped lighter (not shown). Accordingly, the interior bottom portion 124*a* provides a sleeve to receive conventional rectangular shaped flint and wick style lighters. Alternatively, the sleeve can comprise fingers as noted above. One common source for such a rectangular lighter is a windproof lighter sold under the brand name ZIPPO®, by the Zippo Manufacturing Company located in Bradford, Pa. The lighter is preferably of a type that once it is lit it continues to burn for a sufficient amount of time to ignite a briquette without requiring a user to further manipulate the lighter (e.g., once the wick is ignited, fuel is drawn from a reservoir through the wick for continued burning without further action from a user).

Referring to FIGS. 1B and 2A, the housing 102 includes an access hole 126 is provided in the sidewall 104 of the housing 102. The access hole 126 is sized and positioned so that a user's finger can access and operate the lighter 200 when the lighter 200 is seated in the sleeve 124. The lighter can be positioned in the sleeve 124 at a 45 degree angle relative to the access hole 126 with the ignition control (e.g., flint wheel) angled toward the hole 126 so that it is easy to access and operate the lighter via the hole 126 (e.g., by passing a finger through the access hole to spin the flint wheel, thereby creating sparks that ignite fuel on the lighter wick and creates a flame). If the housing includes sleeve 124*a* for a rectangular lighter, the sleeve can be formed at a 45 degree angle relative to the access hole 126 so that the lighter is positioned at the 45 degree angle.

Referring to FIG. 1B, the tray 104 includes a briquette holding portion 128 and a handle 105. The tray 104 is preferably made from a heat resistant material having a low heat conductance. The briquette holding portion 128 of the tray includes a hole 132. As can be seen in FIG. 2*b*, the briquette holding portion 128 and the hole 132 therein are sized and shaped so that a briquette 300 can be seated on the tray 104 with a portion of the briquette 300 disposed over the hole 132. The hole 132 is a heat transfer hole that allows flame and heat that originates from an ingnition source (e.g. lighter 200) located below the tray 104 to pass through the hole 132 to the upper side of the tray 104. The tray 104 is not limited to having a single hole and can have a plurality of holes. The plurality of holes allows heat to reach a briquette seated on an upper surface of the briquette holding portion of the tray. The tray can also include screen or mesh that extends of the hole(s) of the tray. The screen allows heat to pass through while providing a catch to prevent piece of briquette falling through the tray.

The lid 106 includes a plurality of holes 134 and a handle 136, as shown in FIGS. 1B and 2B. The holes 134 allow air to pass from the outside of the housing 102 to an interior of the hosing. The function of the holes 134 will be described in further detail below. The handle 136 permits a user to unseat and remove the lid 106 from the housing 102.

The housing 102 includes a grip member or handle 138. The handle 138 allows the briquette igniter 100 to be transported by a user. The handled is made of a material that does that has a low rate of heat transfer (e.g., ceramic) so that the handle does not become too hot to hold.

Referring now to FIGS. 1B and 2B, an example of operation of the briquette igniter 100 is described. In order to initially set up the briquette igniter 100 for operation, the tray 104 and the lid 106 are removed from the housing 102 so that access to the interior 112 through the top opening 114 is provided. The lighter 200 is inserted through the top opening 114 of the housing and seated in the bottom portion 124 of the housing.

With the lighter 200 seated, the tray 104 is seated on the shoulder 116 of the housing with the tray handle 105 extending through the notch 120 in the housing. A briquette 300 is seated on the tray 104 and at least portion of the briquette disposed over the hole 132. As can be seen in FIG. 2B, the briquette 300 seats over and covers the hole 132. Accordingly, air flow through the hole 132 is restricted because the briquette 300 seats over the hole and acts as a cover. The tray 104 seats with the shoulder 116 of the housing and the handle 105 of the tray seats with the notch 120 of the housing. When seated, air flow around the tray is restricted. Accordingly, the tray 104 and briquette 300 seated on the tray divide the interior of the housing into an upper portion 140 above the tray and a lower portion 142 below the tray. Air flow is restricted between the upper and lower portions 140, 142 such that the tray 104 and briquette 300 create a substantially air tight barrier between the upper and lower portions of the housing.

Once the tray 104 and briquette 300 are seated, the lid 106 is seated on upper edge 122 of the housing 102. A user inserts a finger or other instrument through the access hole 126 so that the user can manipulate the lighter 200 such that it produces a flame (e.g., by rotating a flint strike wheel to ignite fuel on a wick). The lighter 200 is located below the tray 104 and briquette 300 so that the flame of the lighter 200 cause the briquette to heat up until the briquette ignites. Once the briquette ignites it produces smoke and the burning of the briquette consumes oxygen. Smoke (indicated by arrows in FIG. 2B) from the burning of the bottom portion of the briquette fills the lower portion 142 of the housing. The access hole 126 is sized so that enough air enters the lower portion 142 of the chamber to maintain the flame of the lighter 200 prior to ignition of the briquette, but once the briquette ignites the smoke fills the lower portion 142 and extinguishes the flame of the lighter 200. The size of the access hole 126 and the production of smoke and consumption of oxygen caused by the ignition of the briquette create a self-extinguishing effect on the flame of the lighter. In one exemplary embodiment, the diameter of the access hole is about 1.5 inches and the diameter of the housing is about 3.2 inches.

Figure 4:
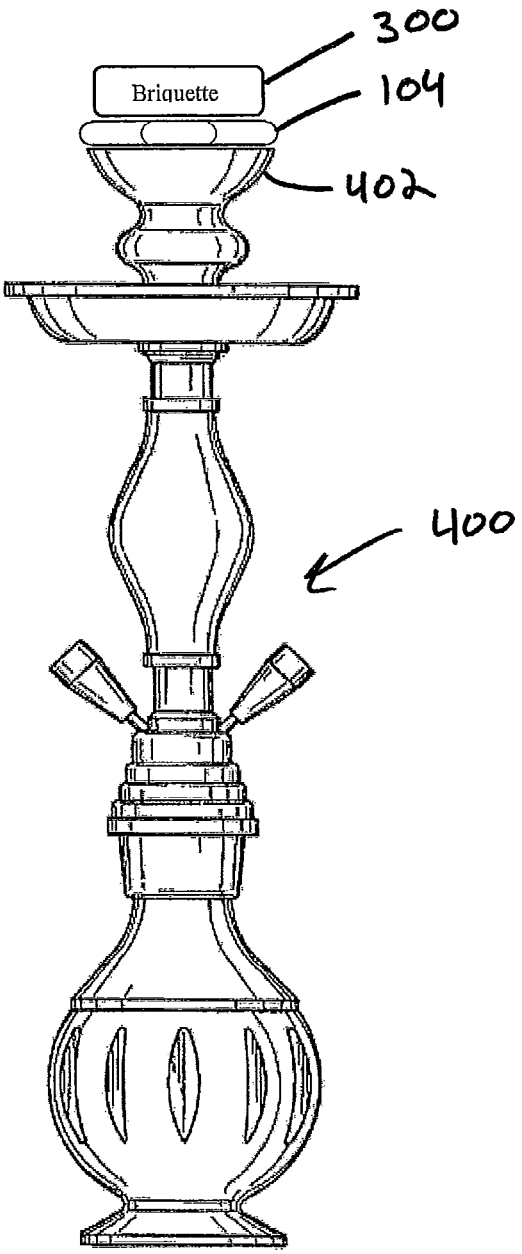
FIG. 4 is a side view of a tray of the ignition device of FIG. 1A seated on a bowl of a hookah.

Once the briquette 300 is burning, smoke escapes through the holes 134 in the lid 106 indicating that the briquette is ready to be used to smoke tobacco. The holes 134 also allow air to enter the upper portion 140 of the housing in order to maintain burning of the briquette. The lid 106 is removed from the housing 102 once the briquette is burning. Using the tray handle 105, the tray 104 with the briquette 300 seated thereon are removed together, from the housing 102. The tray 104 and briquette 300 can be safely transformed to and seated on a bowl 402 of a hookah 400, as shown in FIG. 4. The heat from the burning briquette can pass through the hole 132 in the tray so that the tobacco in the bowl burns during smoking of the hookah. The tray 104 can also be tilted such that the briquette slides off the tray and is seated on the tobacco in the hookah or seated on foil that is over the tobacco.

Accordingly, the ignition device of the present invention provides an easy and safe way to ignite briquettes. The device is relatively small and portable so that the briquettes can be ignited in close proximity to the hookah where tobacco will be smoked. This eliminates the need to transport burning briquettes long distances between the point of ignition and the location of the smoking of the hookah. In addition, the tray 104 can be used to support the briquette during the igniting process in the ignition device and the same tray can be used to support the briquette in relation to the tobacco in the bowl during smoking.

While the invention has been described in connection with certain embodiments thereof, the invention is not limited to the described embodiments but rather is more broadly defined by the recitations in any claims that follow and equivalents thereof.

I claim:

1. An igniter for an incendiary briquette of a type suitable for smoking a smoking substance disposed in a bowl of a hookah, comprising:

a housing defining an interior and having a sidewall, a bottom wall, and a top opening providing access to the interior;

an ignition source disposed in the interior of the housing and supported by the bottom wall, the ignition source producing a flame;

a removable tray for supporting the incendiary briquette, the tray having at least one heat transfer hole therein and sized to be removably supported by the housing at a location above the flame of the ignition source; and a handle attached to the removable tray, wherein the sidewall of the housing includes a notch that is sized and shaped to receive the handle, wherein the handle has a sufficient length such that it extends to an exterior of the housing in a first condition in which the tray is supported by the housing above the flame of the ignition source, wherein heat from the flame flows upwardly through the heat transfer hole to cause a burning of the incendiary briquette in the first condition, and wherein the tray is sized to seat above the bowl of the hookah in a second condition so that heat from the burning briquette flows downwardly through the heat transfer hole to cause a burning of the smoking substance.

2. The igniter of claim 1, further including a lid movably supported relative to the sidewall of the housing, the lid being movable between an open state wherein the interior of the housing is accessible, and a closed state wherein the lid is disposed over the top opening of the housing.

3. The igniter of claim 2, wherein the lid, the tray, and the sidewalls provide a substantially air tight seal in the closed state, and wherein the sidewall of the housing includes an access hole sized to provide finger access to the ignition source and to restrict air flow into the interior of the housing so that the air flow is sufficient to maintain the flame of the ignition source prior to the burning of the incendiary briquette, and the air flow is sufficiently restricted such that upon the burning of the incendiary briquette the interior of the housing fills with smoke causing a self-extinguishing of the flame.

4. The igniter of claim 1, wherein the sidewall of the housing includes an access hole sized and positioned to provide access by a finger to the ignition source.

5. The igniter of claim 1, wherein the tray includes a plurality of heat transfer holes.

6. The igniter of claim 5, further including a mesh supported by tray so that the mesh extends across the plurality of heat transfer holes.

7. The igniter of claim 1, wherein the tray includes a single heat transfer hole.

8. The igniter of claim 7, further including a mesh supported by tray so that the mesh extends across the single heat transfer hole.

9. The igniter of claim 1, wherein the handle is non-heat conducting.

10. The igniter of claim 1, wherein the ignition source is a fuel and wick lighter.

11. The igniter of claim 1, further including a sleeve supported by the bottom wall in the interior of the housing, the sleeve sized to receive the ignition source.

12. The igniter of claim 11, wherein the ignition source is a fuel and wick lighter.

13. The igniter of claim 1, wherein the ignition source is a candle.

14. The igniter of claim 1, further including a grip member supported by the sidewall of the housing.

15. The igniter of claim 14, wherein the grip member is non-heat conducting.

16. A self-extinguishing igniter for an incendiary briquette of a type suitable for smoking a smoking substance disposed in a bowl of a hookah, comprising:

a chimney having walls defining an internal chamber;

an ignition source disposed within the chimney and supported thereby, the ignition source producing a flame;

a removable tray for supporting the incendiary briquette, the tray having at least one heat transfer hole therein and sized to be removably supported by the chimney at a location above the flame of the ignition source, so that heat from the flame flows upwardly through the heat transfer hole to cause a smoking of the incendiary briquette; and a cover movably disposed above the tray, wherein the cover, tray, and walls of the chimney provide a substantially air tight seal, wherein the walls of the chimney include an access hole sized to provide finger access to the ignition source and to restrict air flow into the internal chamber of the chimney so that the air flow is sufficient to maintain the flame of the ignition source prior to a smoking of the incendiary briquette, and the air flow is sufficiently restricted such that upon a smoking of the incendiary briquette the internal chamber fills with smoke causing a self-extinguishing of the flame.

* * * * *